United States Patent [19]

Zinn

[11] Patent Number: 4,985,004

[45] Date of Patent: Jan. 15, 1991

[54] ROUND PIN BUSHING

[75] Inventor: Bernd Zinn, Ennepetal, Fed. Rep. of Germany

[73] Assignee: Grote & Hartmann GmbH & Co. KG, Fed. Rep. of Germany

[21] Appl. No.: 274,191

[22] Filed: Nov. 21, 1988

[30] Foreign Application Priority Data

Nov. 23, 1987 [DE] Fed. Rep. of Germany ... 8715509[U]

[51] Int. Cl.[5] ..... H01R 11/22

[52] U.S. Cl. ..... 439/851; 439/833; 439/130

[58] Field of Search ..... 439/839, 842, 845, 846, 439/848, 849, 850, 352, 354, 357, 358, 266, 268, 270, 851, 833, 130

[56] References Cited

U.S. PATENT DOCUMENTS 3,546,665 12/1970 Zak ..... 439/848
3,573,709 4/1971 Elliot ..... 439/848

FOREIGN PATENT DOCUMENTS 0037995 10/1981 European Pat. Off. ..... 439/849

*Primary Examiner*—David L. Pirlot
*Attorney, Agent, or Firm*—Jones, Askew & Lunsford

[57] ABSTRACT

A round pin bushing of a punched sheet metal part defining an elastically deformable pin receiving orifice area. The orifice area is encompassed by an outer spring sleeve slid thereover. Further disclosed is an expansion lock comprising first and second hook pieces on the orifice-forming portion which mutually engage when a pin is inserted but provide a radial clearance therebetween for expansion when free of an inserted pin.

6 Claims, 2 Drawing Sheets

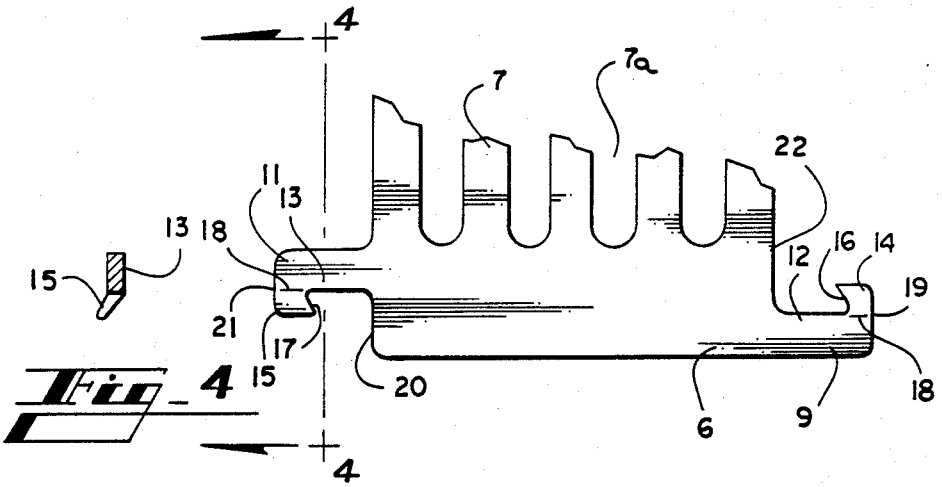
Fig. 4
Fig. 3
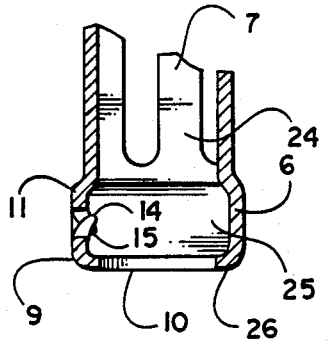
Fig. 6
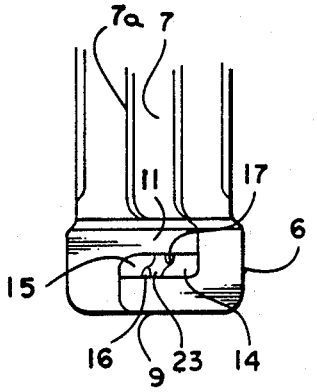
Fig. 5

ROUND PIN BUSHING

This invention concerns a round pin bushing consisting of a punched sheet metal part which functions as an electric contact element in combination with a plug pin. The bushing has a contact area and a crimped area and can be equipped with an outer spring sleeve on the contact area.

The contact area of such round pin bushings should be elastic enough to expand radially when a plug pin is inserted into the round pin bushing. The resultant spring force acting on the plug pin is such that defined contact forces can also act between the plug pin and the contact bushing to assure a reliable long-term electric contact. If the material of which the round pin bushing is made is not suitable, spring sleeves of punched sheet metal parts that sit on the contact area are used to increase the spring force of the round pin bushing. However, for technical assembly reasons, these spring sleeves do not extend all the way to the opening area of the pin bushing.

On insertion of the plug pin, it is possible for the pin not to be axially aligned with the pin bushing so flexural moments can act especially on the area of the opening in the round pin bushing and can cause radial overstressing, so the required contact force there is impaired or may even be lost.

The purpose of the present invention is to create a round pin bushing, especially with an outer spring whereby radial overstressing of the orifice area is prevented.

This invention is explained below in greater detail on the basis of the example illustrated in the figures which show the following:

FIG. 3 shows a top view of the plate of the round pin bushing in the orifice area.

FIG. 4 shows a section through the plate along line 4—4 in FIG. 3 as seen in the direction of the arrow.

FIG. 5 shows a top view of the rolled plate according to FIG. 3.

FIG. 6 shows a longitudinal section through the orifice area according to FIG. 5.

Figure 1:
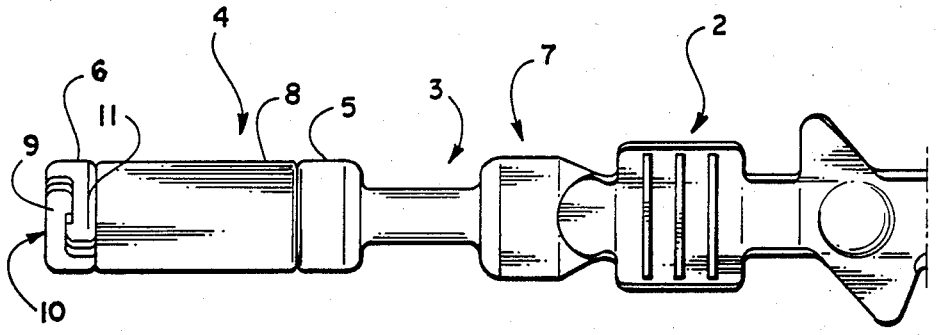
FIG. 1 shows a top view of the round pin bushing.
Figure 2:
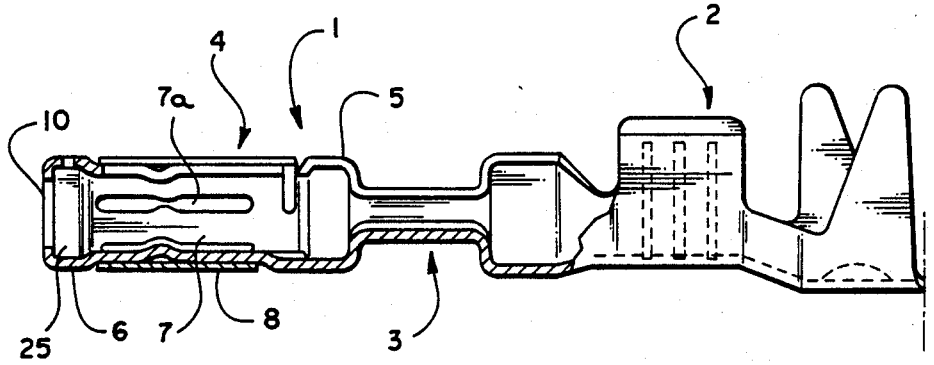
FIG. 2 shows a longitudinal section through the round pin bushing.

The round plug bushing 1 has crimped area 2 for connection to an electric lead (not shown), a transition area 3 and a contact area 4 with an orifice opening 10. Since this invention does not actually consist of the areas 2 and 3, they can conform to the usual design and therefore will not be discussed further here.

Contact area 4 has a hollow cylindrical shape and a mouth bead 6 bulging outward in the shape of a tire, and in the axial area there is a bead 5 bulging outward in the shape of a tire at the rear end. Spring arms 7 extending axially at a radial distance *7a* are provided between beads 5 and 6 as connecting elements. A cylindrical spring sleeve 8 of a punched sheet metal part sits on spring arms 7.

It is essential for the orifice area 6 to be provided with an expansion lock for the round pin bushing. This expansion lock consists of a first hook piece 9 that extends in peripheral direction and is directly at orifice 10. The second hook piece 11 is axially aligned with the former and behind it. The shape of the hook pieces 9 and 11 can be seen in FIGS. 3 and 4. They consist of diametrically attached tabs 12, 13 of approximately the same width and same length on which there are barbs 14 and 15 which are bent inward, i.e., toward the inside of the bushing along bending lines 18, likewise diametrically opposed, with their front edges 16, 17 positioned opposite each other so they cross when they come together.

The shape of hook pieces 9 and 11 is such that the radial end areas of hook pieces 9 and 11 each form a butt edge 19, 21 such that the butt edge 19 which runs axially on hook piece 9 abuts against an axial butt edge 20 on the orifice, bead 6, and axial butt edge 21 of hook piece 11 abuts against axial butt edge 22 on orifice bead 6, so the orifice area of the round plug bushing 1 is supported against pressure from the outside (FIG. 5).

The front edges 16 and 17 of barbs 14, 15 are arranged at a distance with a gap 23. The orifice area 6 and round plug bushing 1 can be enlarged by the width of this gap 23 until barbs 14, 15 come in contact with each other. The barbs then act as an expansion lock. Due to the fact that the orifice area 6 is designed as a bead, this yields an enlarged diameter of the inside space 25 relative to the diameter of the inside space 24 of contact area 4 of round plug bushing 1, and the edges 26 of orifice 10 are flanged inward. Barbs 14, 15 are bent into the interior space 25 in such a way that they project no further into the interior space 25 than the expansion of the diameter so they do not project into the interior space 24. This prevents barbs 14, 15 from striking the plug pin (not shown) when the plug connection is established.

I claim:

1. A round pin bushing that functions as an electric contact element in combination with a plug pin, comprising:

a punched sheet metal part having a contact area including an orifice area for receiving a plug pin, and having a crimped area for connection to an electric lead;

an outer spring sleeve fitted on the contact area;

the orifice area being provided with an expansion lock having a first hook piece (9) extending in circumferential direction and a second hook piece (11) positioned behind and in axial alignment with the first hook piece for selective mutual engagement with the first hook piece; and a radial clearance between the first and second hook pieces so as to permit expansion of the orifice.

2. Round pin bushing according to claim 1, characterized in that the hook pieces (9) and (11) are formed from diametrically attached tabs (12, 13) of approximately the same width and same length with bars (14,15) bent inward toward the interior of the bushing along bending lines (18) positioed on the tabs and bent at a right angle, likewise diametrically opposed to each other, with their front edges (16,17) positioned opposite each other.

3. Round pin bushing according to claim 1, characterized in that the hook pieces (9 and 11) have radial end areas each forming an axial butt edges (19, 21) such that the axial butt edge (19) of the hook piece (9) abuts against an axial butt edge (20) in the orifice area (6), and the axial butt edge (21) of hook piece (11) abuts against an axial butt edge (22) in the orifice area (6), so that orifice area of the round pin busihing (1) is supported against pressure from the outside.

4. Round pin bushing according to claim 1, characterized in that the barbs (14, 15) have front edges (16 and 17) that are positioned at a distance with a gap (23) for the radial clearance.

5. Round pin bushing according to claim 1, characterized in that the orifice area (6) is designed as a bead so as to yield an expanded diameter of the interior space (25) of the bead relative to the diameter of the interior space (24) of the contact area of the round pin bushing (1), and the edges (26) of the orifice (10) in the mouth area (6) are flanged inward.

6. Round pin bushing according to claim 5, characterized in that the barbs (14, 15) are bent into the interior space (25) in such a way that they project no further into the interior space (25) than the expansion of the diameter so that the barbs do not project into the interior space (24).

* * * * *

UNITED STATES PATENT AND TRADEMARK OFFICE

CERTIFICATE OF CORRECTION

PATENT NO. : 4,985,004

DATED : January 15, 1991

INVENTOR(S) : BERND ZINN

It is certified that error appears in the above-identified patent and that said Letters Patent is hereby corrected as shown below:

Column 2:

Claim 2, line 50, change "bars" to --barbs--;

Claim 3. line 3, change "edges" to --edge--;

Column 4:

claim 6, line 5, insert a comma (,) immediately following "diameter".

Signed and Sealed this

Fourth Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,985,004

DATED : January 15, 1991

INVENTOR(S) : BERND ZINN

It is certified that error appears in the above-identified patent and that said Letters Patent is hereby corrected as shown below:

Column 2, line 52, change "positioed" to --positioned--.

Column 2, line 63, change "busihing" to --bushing--.

Signed and Sealed this

Third Day of August, 1993

*Attest:*

Michael K. Kirk

MICHAEL K. KIRK

*Attesting Officer*

*Acting Commissioner of Patents and Trademarks*